US009150372B2

(12) United States Patent
Matsumoto

(10) Patent No.: US 9,150,372 B2
(45) Date of Patent: Oct. 6, 2015

(54) IMAGE FORMING APPARATUS

(71) Applicant: Oki Data Corporation, Tokyo (JP)

(72) Inventor: Keigo Matsumoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/975,432

(22) Filed: Aug. 26, 2013

(65) Prior Publication Data

US 2014/0054843 A1 Feb. 27, 2014

(30) Foreign Application Priority Data

Aug. 27, 2012 (JP) ..... 2012-186447

(51) Int. Cl.

| | |
|---|---|
| ***G03G 21/16*** | (2006.01) |
| ***B65H 9/06*** | (2006.01) |
| ***B65H 5/02*** | (2006.01) |
| ***B65H 5/06*** | (2006.01) |
| ***B65H 5/38*** | (2006.01) |

(52) U.S. Cl.

CPC ..... *B65H 9/06* (2013.01); *B65H 5/025* (2013.01); *B65H 5/062* (2013.01); *B65H 5/38* (2013.01); *G03G 21/168* (2013.01); *G03G 21/1638* (2013.01); *G03G 21/1647* (2013.01); *G03G 21/1695* (2013.01); *B65H 2402/10* (2013.01); *B65H 2402/441* (2013.01); *B65H 2402/61* (2013.01); *B65H 2404/6111* (2013.01); *G03G 2215/00675* (2013.01); *G03G 2221/1684* (2013.01)

(58) Field of Classification Search

CPC ..... G03G 21/1638; G03G 21/1695; G03G 21/1647; G03G 21/168; G03G 2221/1684

USPC ..... 271/10.1, 4.09, 4.1; 399/121

See application file for complete search history.

(56) References Cited

U.S. PATENT DOCUMENTS

| | | | | |
|---|---|---|---|---|
| 7,620,344 | B2 * | 11/2009 | Igarashi | 399/110 |
| 7,957,672 | B2 * | 6/2011 | Kato et al. | 399/121 |
| 8,081,902 | B2 * | 12/2011 | Hayakawa et al. | 399/121 |
| 2007/0231032 | A1 * | 10/2007 | Matsuno | 399/388 |
| 2011/0091238 | A1 * | 4/2011 | Nakazawa | 399/110 |

FOREIGN PATENT DOCUMENTS

| | | | |
|---|---|---|---|
| JP | 10-319731 | A | 12/1988 |
| JP | 8-110665 | A | 4/1996 |
| JP | 2007-101728 | A | 4/2007 |
| JP | 2010-107641 | A | 5/2010 |
| JP | 2011-059578 | A | 3/2011 |

* cited by examiner

*Primary Examiner* — Luis A Gonzalez

(74) *Attorney, Agent, or Firm* — Muncy, Geissler, Olds & Lowe, P.C.

(57) ABSTRACT

An image forming apparatus includes a device main body, a detachable unit that is detachable and attachable to the device main body, a sheet guide that guides a pathway of sheet, and a guide position part that regulates a position of the sheet guide. The guide position part is disposed in the device main body, the sheet guide is disposed movably with respect to the detachable unit, and when the detachable unit is mounted on the device main body, a position of the sheet guide is regulated by abutting the guide position part.

18 Claims, 13 Drawing Sheets

IMAGE FORMING APPARATUS

CROSS REFERENCE TO RELATED APPLICATION

The present application is related to, claims priority from and incorporates by reference Japanese Patent Application No. 2012-186447, filed on Aug. 27, 2012.

The present invention relates to an image forming apparatus having a detachable unit to be able to attach and detach with respect to a device main body (or apparatus main body).

BACKGROUND

Conventionally, there are image forming apparatuses having a detachable unit (or detach-attach able unit) able to be able to attach and detach with respect to a device main body (for example, refer to JP2011-59578 and JP2007-101728).

However, in conventional image forming apparatuses, the sheet guide to guide the sheet to the detachable unit is disposed in the device main body. Therefore, in the conventional devices, the detachable unit and the sheet guide are respectively independently positioned. As a result, the conventional devices have a problem that the position accuracy sometimes decreases and it disturbs the sheet carrying.

The present invention is to solve the problem described above. The main purpose for this invention is to provide an image forming apparatus, wherein the detachable unit is installed in the device main body so that a sheet guide is positioned at the predetermined position at the same time.

SUMMARY

An image forming apparatus disclosed as one embodiment of the invention includes a device main body, a detachable unit that is detachable and attachable to the device main body, a sheet guide that guides a pathway of sheet, and a guide position part that regulates a position of the sheet guide. The guide position part is disposed in the device main body, the sheet guide is disposed movably with respect to the detachable unit, and when the detachable unit is mounted on the device main body, a position of the sheet guide is regulated by abutting the guide position part.

In the image forming apparatus, the sheet guide is movably disposed on the detachable unit. When the detachable unit is mounted on the device main body, the sheet guide abuts the guide position part so that the position of the sheet guide is regulated. With the structure, the image forming apparatus positions the sheet guide at a predetermined position at the same time when the detachable unit is mounted on the apparatus main body.

According to this invention, it is possible to provide the image forming apparatus, wherein the detachable unit is installed in the device main body so that a sheet guide is positioned at the predetermined position at the same time.

DETAILED DESCRIPTION OF EMBODIMENTS

Hereinafter, referring to figures, the embodiment of the present invention (hereinafter referred to as "the embodiment") is explained in details. Each figure is schematically illustrating the present invention well enough to understand. Therefore, the present invention is not limited to the illustrated examples. Also, in each figure, the common component and the same component are showed with the same marks, and those repeated explanations are omitted.

First Embodiment

Configuration of Image Forming Apparatus

Figure 1:
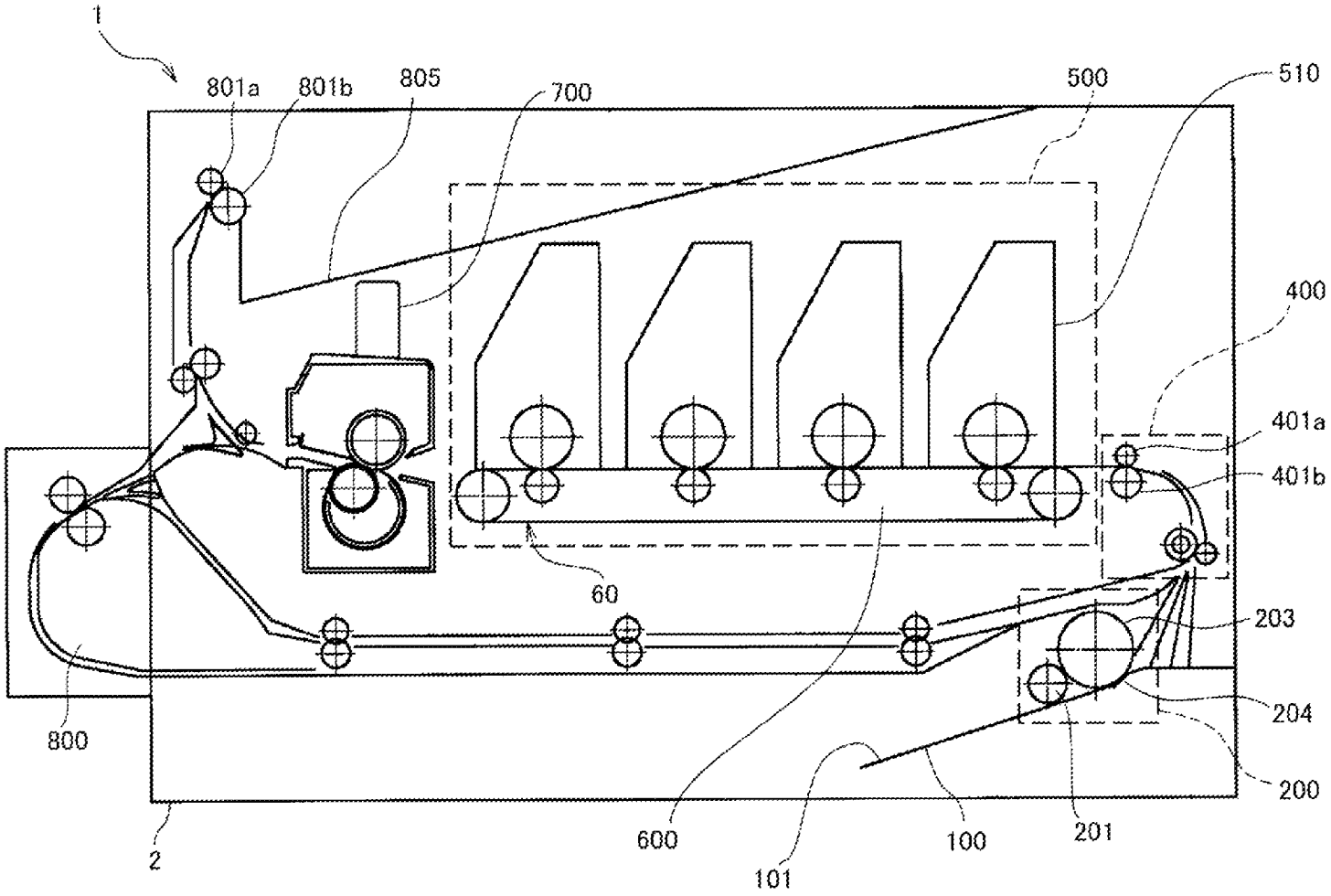
FIG. 1 is a view illustrating a configuration of an image forming apparatus according to the first embodiment.

Referring to FIG. 1, the configuration of the image forming apparatus according to the first embodiment is explained. FIG. 1 is a view illustrating the configuration of the image forming apparatus according to the first embodiment. Here, assuming that the image forming apparatus 1 is configured as a tandem style direct transfer method color printer, the embodiment is explained. Also, "upstream" and "downstream" explained below are based on the carrying direction of the sheet.

As illustrated in FIG. 1, the image forming apparatus 1 according to the first embodiment is provided with the sheet tray 100, the sheet delivery part 200, the sheet carrying part 400, the image forming part 500, the fuser part 700, and the reverse part 800 inside the frame configures the case of the device main body (hereinafter "the main body frame").

The sheet tray 100 is a contain part to contain the sheet 101 as a print medium. In the sheet tray 100, the sheets 101 are laminated inside. In the sheet tray 100, the sheet delivery part 200 is disposed at the delivery side.

The sheet delivery part 200 is a mechanism to deliver the sheets 101 to the downstream side one by one. The sheet delivery part 200 is provided with the pickup roller 201, the feed roller 203, and the separation piece 204. The pickup roller 201 is a roller to contact and press against the sheet 101 raised to the certain height by a bias method (not illustrated) and delivers the sheet 101 to the downstream side. The feed roller 203 and the separation piece 204 are components to separate the sheets 101 one by one by putting the sheet 101 delivered by the pickup roller 201 therebetween.

The sheet carrying part 400 is a mechanism to carry the sheet 101 delivered by the sheet delivery part 200 to the image forming part 500. In the first embodiment, the sheet carrying part 400 has a configuration to curve the sheet 101 and carry the sheet 101 toward the image forming part 500. The sheet carrying part 400 is provided with plural pairs of the sheet carrying rollers 401*a* and 401*b*. One of the sheet carrying rollers 401*a* and 401*b* is configured as a driving roller, and the other is configured as a driven roller. The sheet carrying rollers 401*a* and 401*b* carry the sheet 101 to the image forming part 500 by putting the sheet 101 between them while one of the rollers configured as a driving roller is rotating.

The image forming part 500 is a mechanism to form the image to transfer to the sheet 101. The image forming part 500 is provided with the toner image forming part 510 and the transfer part 600. The toner image forming part 510 is a mechanism to form the image (toner image) on the surface of the photosensitive drum 511 (refer to FIG. 2) disposed inside based on the print data sent from the host device (not illustrated) using the toner that is a developer. The transfer part 600 is a mechanism to transfer the image (toner image) formed on the surface of the photosensitive drum 511 to the surface of the sheet 101 by the Coulomb force. The configuration around the image forming part 500 is described later. The image forming part 500 carries the sheet 101 to which the toner image is transferred to the fuser part 700.

In the first embodiment, the toner image forming part 510 has a detachable configuration (to be able to attach and detach) with respect to the main body frame 2 (hereinafter, sometimes referred to as a "device main body"). Also, in the first embodiment, in the image forming apparatus 1, four of the toner image forming parts 510 corresponding to each color of black (K), yellow (Y), magenta (M), and cyan (C) are disposed. The Four toner image forming parts 510 are disposed to tandemly line up from the upstream side toward the downstream side. Four toner image forming parts 510 have the same configuration except that the colors of the developers contained inside are different.

Also, in the first embodiment, the transfer part 600 is configured as a sheet carrying unit to carry the sheet 101. Then, the transfer part 600 as a sheet carrying unit is configured as a detachable unit 60 to be able to attach and detach with respect to the main body frame 2 (device main body).

The fuser part 700 is a mechanism to heat and pressurize the sheet 101 and to secure the toner image transferred to the surface of the sheet 101 by melting. The image forming apparatus 1 ejects the sheet 101 toward the stack part 805 by the ejection rollers 801*a* and 801*b* after the toner image is secured on the sheet 101 by the fuser part 700. The stack part 805 is a part to stack the sheet 101 on which the toner image is secured. In the example illustrated in FIG. 1, the stack part 805 is disposed at the exterior part of the image forming part 500 of the upper part of the image forming part 500. The sheet 101 is ejected on the stack part 805 through an ejection opening (not illustrated).

The reverse part 800 is a mechanism to reverse the sheet 101 when the double sided printing is conducted. The reverse part 800 reverses the sheet 101 ejected from the fuser part 700 and sends it back to the sheet carrying part 400. The sheet carrying part 400 carries the reversed sheet 101 to the image forming part 500. In the image forming part 500, the toner image forming part 510 forms the toner image on the surface of the photosensitive drum 511, and the transfer part 600 transfers the image formed on the surface of the photosensitive drum 511 to the back surface of the sheet 101. The image forming part 500 carries the sheet 101 on which the toner image is transferred toward the fuser part 700 again. As a result, the fuser part 700 heats and pressurizes the sheet 101 and secures the toner image transferred to the back surface of the sheet 101 by melting. The image forming apparatus 1 carries the sheet 101 by the ejection rollers 801*a* and 801*b* and ejects the sheet 101 on the stack part 805 after the toner image is secured on the sheet 101.

Configuration Around Image Forming Part

Figure 2:
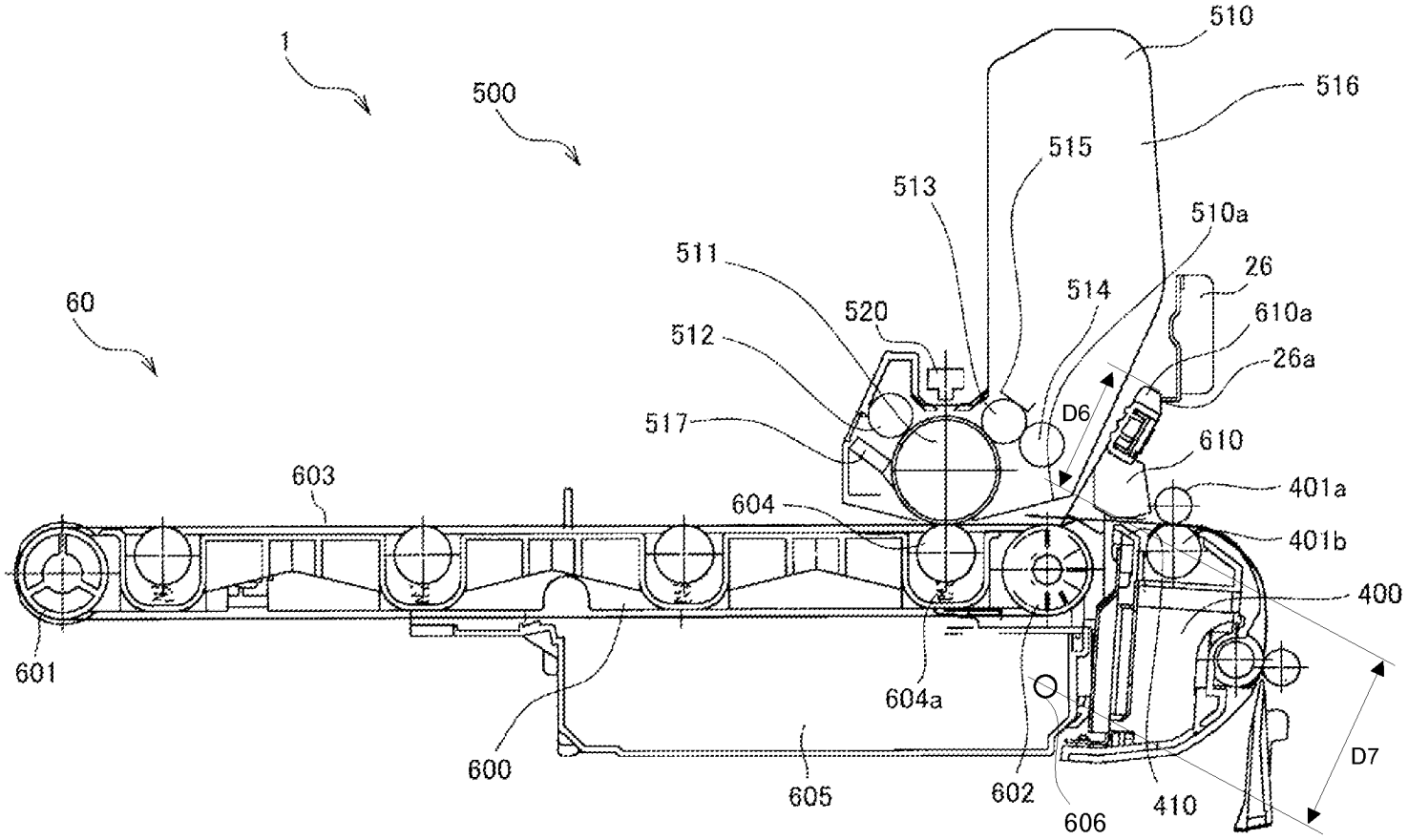
FIG. 2 is a view illustrating a configuration around an image forming part of the image forming apparatus according to the first embodiment.
Figure 3:
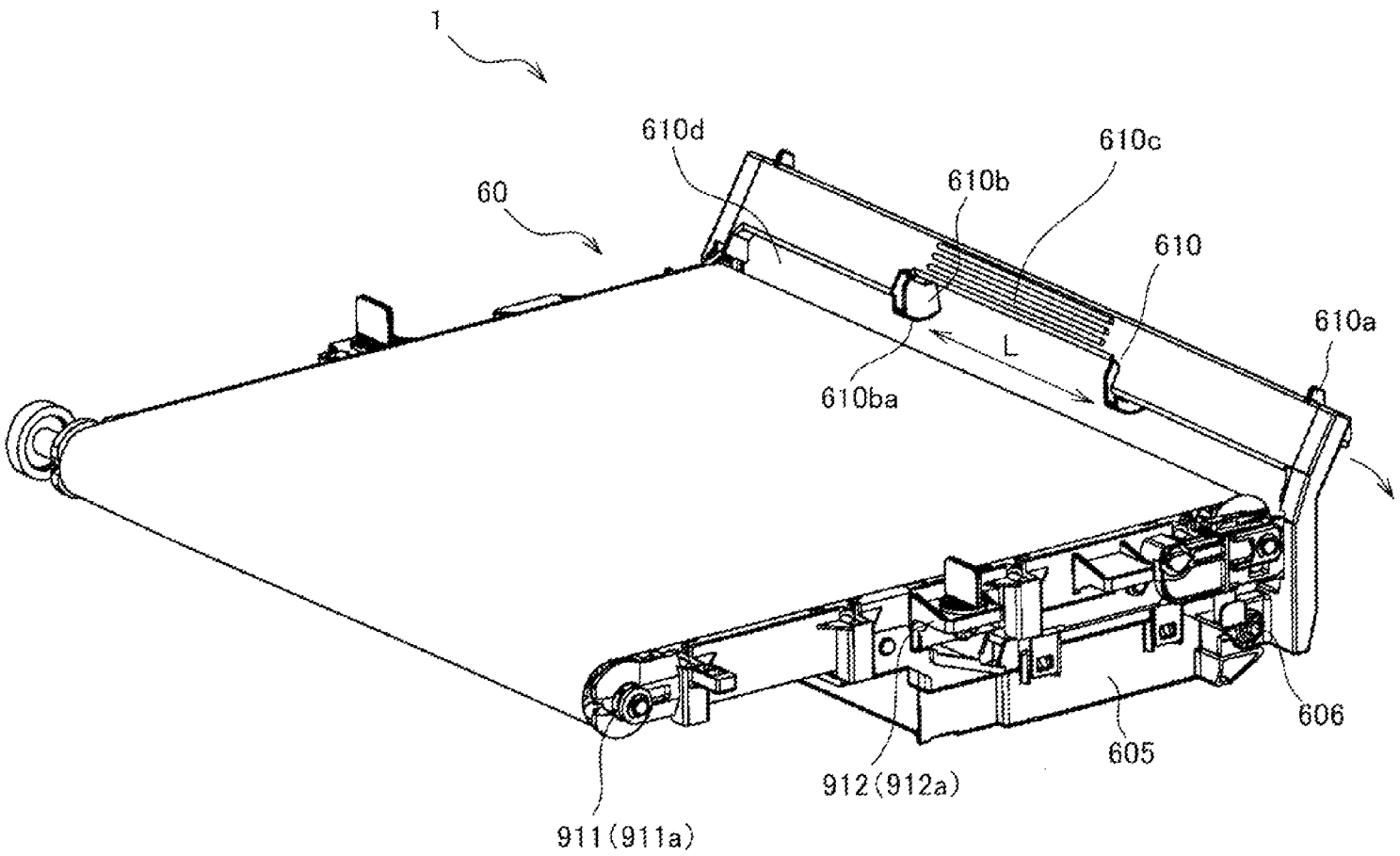
FIG. 3 is a view (1) illustrating a configuration of a detachable unit according to the first embodiment. The unit is in an assembled status.
Figure 4:
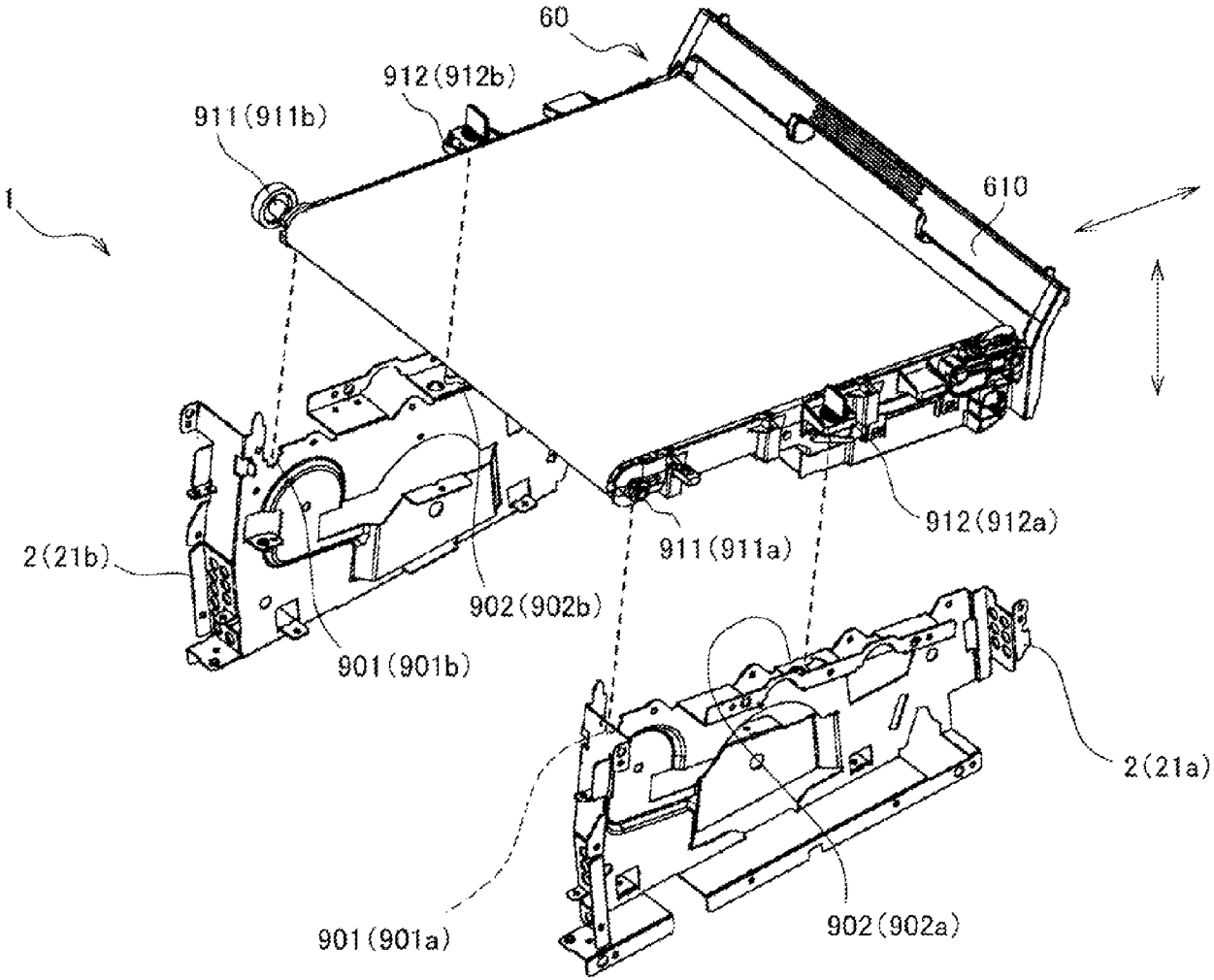
FIG. 4 is a view (2) illustrating a configuration of the detachable unit according to the first embodiment. The unit is in a breakdown status.
Figure 5B:
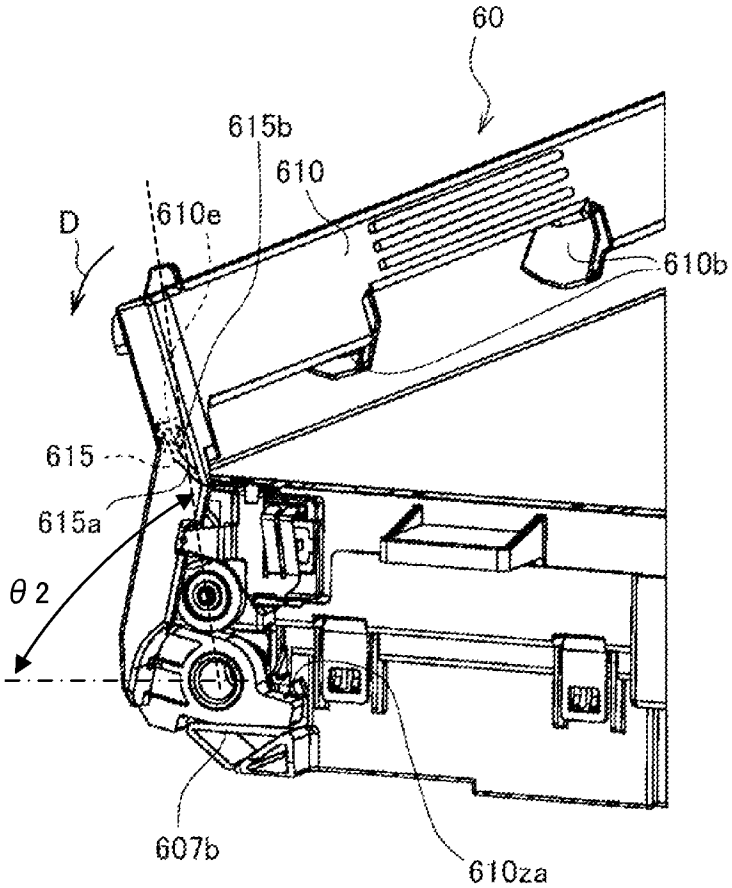
FIGS. 5A and 5B are views (3) illustrating configurations of the detachable unit according to the first embodiment.

Referring to FIG. 2 to FIG. 5B, the configuration around the image forming part 500 is explained. FIG. 2 is a view illustrating the configuration around the image forming part 500 of the image forming apparatus 1 according to the first embodiment. Also, FIGS. 3, 4, and 5 are views respectively illustrating the configuration of the detachable unit 60 according to the first embodiment.

As described above, the image forming part 500 is provided with the toner image forming part 510 and the transfer part 600. The undersurface of the case of the toner image forming part 510 is formed as a flat slope surface, and the slope surface functions as the guide surface 510*a* to guide the traveling of the sheet 101. The toner image forming part 510 has a configuration to be able to attach and detach with respect to the main body frame 2 (device main body) as described above. Also, in the first embodiment, the transfer part 600 is configured as the sheet carrying unit to carry the sheet 101 and the detachable unit 60 to be able to attach and detach with respect to the main body frame 2 (device main body) as described above.

As illustrated in FIG. 2, the toner image forming part 510 is provided with the photosensitive drum 511, the charge roller 512, the development roller 513, the supply roller 514, the development blade 515, the toner contain part 516, and the cleaning member 517. Also, in the image forming apparatus 1, the LED head 520 is established outside of the toner image forming part 510, around the photosensitive drum 511, and between the charging roller 512 and the development roller 513.

The photosensitive drum 511 is a member on the surface of which the electrostatic latent image and the toner image are formed. The charge roller 512 is a member to equally charge the surface of the photosensitive drum 511. In the image forming apparatus 1, the charge roller 512 equally charges the surface of the photosensitive drum 511. After that, the LED head 520 partially exposes the surface of the photosensitive drum 511 based on the print data sent from the host device (not illustrated). Thereby, the image forming apparatus 1 forms the electrostatic latent image on the surface of the photosensitive 511.

The development roller 513 is a developer carrier to hold the toner as a developer on the surface. The development roller 513 supplies the toner to the photosensitive drum 511 on which the electrostatic latent image is formed and develops (visualizes) the electrostatic latent image as the toner image. The supply roller 514 is a member to supply the toner to the development roller 513. The development blade 515 is a member to regulate the layer thickness of the toner adhered on the surface of the development roller 513. The toner contain part 516 is a space to contain the toner to supply to the supply roller 514.

The cleaning member 517 is a member to contact the surface of the photosensitive drum 511 and scrape the remaining toner from the surface of the photosensitive drum 511. Here, "the remaining toner" means the toner remained on the surface of the photosensitive drum 511 after the transfer part

600 conducts the transfer treatment of the toner from the photosensitive drum 511 to the sheet 101. The LED head 520 is a exposure part to irradiate light on the surface of the photosensitive drum 511 and partially expose the surface of the photosensitive drum 511 based on the print data sent from the host device (not illustrated). The image forming apparatus 1 can use a laser light source and the like instead of the LED head 520.

Also, the transfer part 600 is provided with the belt rollers 601 and 602, the carrying belt 603, the transfer roller 604, the spring 604*a*, the waste toner box 605, and the sheet guide 610.

The belt rollers 601 and 602 are a pair of rollers that extend the carrying belt 603 between them and provide a tension to the rollers. One of the belt rollers 601 and 602 is configured as a driving roller, and the other is configured as a driven roller. The belt rollers 601 and 602 make the carrying belt 603 run when one of the rollers configured as a driving roller rotates.

The carrying belt 603 is an endless belt member to carry the sheet 101. In the first embodiment, four toner image forming parts 510 are arranged on the carrying belt 603. The carrying belt 603 carries the sheet 101 so that the sheet 101 passes between the photosensitive drums 511 of the four image forming parts 510 and the four transfer rollers 604 arranged to face each of the photosensitive drums 511.

The transfer roller 604 is a member to pull the toner image formed on the surface of the photosensitive drum 511 by the Coulomb force. The transfer roller 604 is arranged to face the photosensitive drum 511 via the carrying belt 603. In the first embodiment, the image forming apparatus 1 has four toner image forming parts. Therefore, the image forming apparatus 1 has a configuration that four transfer rollers 604 are arranged to respectively face the photosensitive drums 511 of four toner image forming parts 510. The spring 604*a* is a member to push the transfer roller 604 to the photosensitive drum 511 side.

The waste toner box 605 is a container to contain the toner to discard (waste toner). In the image forming apparatus 1, the cleaning member (not illustrated) is disposed above the waste toner box 605. The cleaning member (not illustrated) scrapes the toner adhered on the carrying belt 603 from the carrying belt 603 after the transfer treatment. The waste toner box 605 contains the toner scraped by the cleaning member (not illustrated) as the waste toner.

The sheet guide 610 is a member to guide the traveling of the sheet 101 by putting the sheet 101 between the sheet guide 610 and the carrying part guide 410 described later. The sheet guide 610 is arranged between the sheet carrying part 400 and the toner image forming part 510 of the most upstream side of the image forming part 500.

In this embodiment, the image forming apparatus 1 has a configuration that the sheet carrying part 400 makes the sheet 101 curve and carries the sheet 101 toward the toner image forming part 510 of the most upstream side of the image forming part 500. Therefore, the sheet 101 easily lifts up before it gets to the toner image forming part 510 of the most upstream side. The sheet guide 610 pushes the sheet 101 from top and prevents the sheet 101 from lifting up by curve-carrying.

The sheet guide 610 is movably disposed in the detachable unit 60, the sheet guide 610 contacts the guide position part 26*a* described later (referring to FIG. 2) when the detachable unit 60 is installed in the main body frame 2, and the position of the sheet guide 610 is regulated.

In the first embodiment, as illustrated in FIG. 3, the shaft of the sheet guide 610 is supported by the shaft part 60 disposed in the waste toner box 605 of the detachable unit 60. Therefore, in the first embodiment, the sheet guide 610 has a configuration to be able to rotate and move around the shaft part 606. When the detachable unit 60 is installed in the main body frame 2, the sheet guide 610 has a configuration that the abutment part 610*a* described later contacts the guide position parts 26*a* (referring to FIG. 2), and the position of the abutment part 610*a* is determined.

As illustrated in FIG. 3, the sheet guide 610 is formed so that the part the sheet 101 passes is opened as the aperture part 610*d*. Also, the sheet guide 610 is provided with the abutment part 610*a*, the guide part 610*b*, and the grip part 610*c*.

As illustrated in FIG. 2, the abutment part 610*a* is a part on which the tip of the protrusion part 26*a* of the sheet metal 26 (described later) abuts. The sheet metal 26 is disposed in the main body frame 2 arranged at the upstream side. The abutment part is formed protruding in the direction of the sheet metal 26 (refer to FIG. 2).

The guiding part 610*b* is a part to contact the sheet 101 carried by the sheet carrying part 400 and guide the traveling of the sheet 101. The guide part 610*b* is formed so as to protrude toward the lower direction from the grip part 610*c* (that is, the inside direction of the aperture part 601*d*). The undersurface of the lower end part of the guide part 610*b* is formed as the guide surface 610*ba*. The guide surface 610*ba* is the surface to contact the upper surface of the sheet 101. The guide surface 610*ba* is formed in the round shape (or curved shape).

The handle part 610*c* is a grip part gripped by the user. By gripping the handle part 610*c*, the user can lift the detachable unit 60. The handle part 610*c* is disposed above the aperture part 610*d*.

In the example illustrated in FIG. 3, two guide parts 610*b* are disposed at both sides of the handle part 610*c*. Here, the distance (interval) between two guide parts 610*b* is defined as L and used in the explanation. The distance L is set to be narrower value than the width of the sheet 101 that the image forming apparatus 1 can carry. For example, the distance L may be set to be the value of about 100 mm when the width of the sheet 101 that the image forming apparatus 1 can carry is 148 mm. Also, the distance L may be set to be the narrower value than the width of the sheet 101 that is a regular sized sheet and the smallest size on which the image forming apparatus 1 can print. Also, the distance L may be set to be the narrower value than the width of the sheet 101 on which the image forming apparatus 1 can print both sides when the image forming apparatus 1 is a device that can print both sides.

In the first embodiment, as illustrated in FIG. 2, in the image forming apparatus 1, the carrying part guide 410 is disposed in the sheet carrying part 400. The carrying part guide 410 is a member to guide the traveling of the sheet 101 by putting the sheet 101 between the carrying part guide 410 and the sheet guide 610. The carrying part guide 410 is disposed at the position that the upper end part of the carrying part guide 410 faces the guide surface 610*ba* (described later) formed on the sheet guide 610.

Also, in this embodiment 1, as illustrated in FIG. 2, the sheet metal 26 is disposed in the main body frame 2. The sheet metal 26 is a contact member to contact the sheet guide 610. A part of the sheet metal 26 is formed as the protrusion part 26*a* protruding in the direction of the sheet guide 610. The tip of the protrusion part 26*a* abuts the abutment part 610*a* of the sheet guide 610. Thereby, the sheet metal 26 positions the abutment part 610*a* of the sheet guide 610 at the predetermined position (the third position P3 described later (refer to FIG. 6)). Hereinafter, the protrusion part 26*a* of the sheet metal 26 is referred to as the "guide position part 26*a*."

In this embodiment 1, in the image forming apparatus 1, the carrying part guide 410 is arranged between the shaft part 606 and the guide surface 610*ba* of the sheet guide 610 so as to face the guide surface 610*ba* with the predetermined interval. Also, the guide surface 610*ba* (refer to FIG. 3) is arranged so as to position between the guide position part 26*a* (refer to FIG. 2) and the shaft part 606 (refer to FIG. 3). Furthermore, the guide surface 610*ba* (refer to FIG. 3) is arranged so that a distance D6 from the guide surface 610*ba* (refer to FIG. 3) to the guide position part 26*a* (refer to FIG. 2) is shorter than another distance D7 from the guide surface 610*ba* (refer to FIG. 2) to the shaft part 606 (refer to FIG. 3). The distances D6 and D7 are shown in FIG. 2.

By arranging each configuration element in such way, the image forming apparatus 1 can decrease the change of the positional relation between the guide surface 610*ba* (refer to FIG. 3) and the carrying part guide 410 (refer to FIG. 2) accompanied by the attachment error or the manufacturing error of the guide position part 26*a* (refer to FIG. 2) in the carrying direction of the print medium.

Also, in the first embodiment, as illustrated in FIG. 4, the image forming apparatus 1 has the side frames 21*a* and 21*b* to configure the side parts of the main body frame 2. The ditch part 901*a* and the abutment part 902*a* are disposed on the side frame 21*a*. Also, the ditch part 901*b* and the abutment part 902*b* are disposed on the side frame 21*b*. Also, in the image forming apparatus 1, the first engagement parts 911*a* and 911*b* and the second engagement parts 912*a* and 912*b* are disposed on the detachable unit 60.

The ditch part 901*a* of the side frame 21*a* is a part to engage with the first engagement part 911*a* disposed on the detachable unit 60. Also, the ditch part 901*b* of the side frame 21*b* is a part to engage with the first engagement part 911*b* disposed on the detachable unit 60. The ditch parts 901*a* and 901*b* are formed so that the corresponding first engagement parts 911*a* and 911*b* fit inside. Hereinafter, the ditch parts 901*a* and 901*b* are sometime referred to as "the ditch part 901" together. Also, the first engagement parts 911*a* and 911*b* are sometimes referred to as "the first engagement part 911" together. The first engagement part 911 fit inside of the ditch part 901, so the ditch part 901 functions as a horizontal direction position regulation part to regulate the position toward the sheet metal 26 of the detachable unit 60, that is, the horizontal direction position of the detachable unit 60. In the embodiment, the ditch part 901 was described to regulate a movement of the sheet metal 26 in the horizontal direction. However, it is not necessary to interpret the direction exactly perpendicular to gravity. In the light of the invention, it is proper to read that the horizontal direction means a parallel direction along a sheet carrying direction or the same direction as a driving surface of the carrying belt (for example carrying belt 603). Further, it is noted that, where the image forming apparatus is installed in a vertical way, which is upright, the horizontal direction above means a vertical direction according to the direction in which the sheet is carried. It is also noted that, where the image forming apparatus is installed with an angle (or inclined), the horizontal direction inclines accordingly. Therefore, the horizontal direction position regulation part may be defined as a sheet carrying direction regulation part that functions to regulate it in the sheet carrying direction.

The abutment part 902*a* of the side frame 21*a* is a part to engage with the second engagement part 912*a* disposed on the detachable unit 60. Also, the abutment part 902*b* of the side frame 21*b* is a part to engage with the second engagement part 912*b*. The abutment parts 902*a* and 902*b* are formed so that the corresponding second engagement parts 912*a* and 912*b* mount on the abutment parts 902*a* and 902*b*, and the abutment parts 902*a* and 902*b* support the second engagement part 912*a* and 912*b* from bottom. Hereinafter, the abutment parts 902*a* and 902*b* are sometimes referred to as "the abutment part 902" together. Also, the second engagement parts 912*a* and 912*b* are sometimes referred to as "the second engagement part 912" together. The abutment part 902 functions as the vertical direction position regulation part to regulate the vertical direction position of the detachable unit 60 by supporting the second engagement part 912 from bottom. In the embodiment, the abutment part 902 was described to regulate a movement of the detachable unit 60 in the vertical direction. However, it is not necessary to interpret the direction exactly identical to the gravity. In the light of the invention, it is proper to read that the vertical direction means a parallel direction along a direction in which the unit is detached/attached. Further, it is noted that, where the image forming apparatus is installed in a vertical way, which is upright, the vertical direction above means a horizontal direction according to the direction in which the unit is detached/attached. It is also noted that, where the image forming apparatus is installed with an angle (or inclined), the vertical direction inclines accordingly. Therefore, the vertical direction position regulation part may be defined as a unit direction regulation part that functions to regulate it in the detachable/attachable direction of the detachable unit.

The first engagement parts 911*a* and 911*b* of the detachable unit 60 are respectively formed as the round shaped shaft to abut in the width direction. The first engagement parts 911*a* and 911*b* fit inside of the ditch parts 901*a* and 901*b* disposed on the corresponding side frames 21*a* and 21*b*.

Also, the second engagement parts 912*a* and 912*b* of the detachable unit 60 are formed as the flat board form protrusion part to respectively protrude in the width direction. The second engagement parts 912*a* and 912*b* mount on the protrusion parts 902*a* and 902*b* disposed on the corresponding side frames 21*a* and 21*b*.

The ditch part 901*a* and 901*b* of the side frame 21*a* and 21*b* engage with the first engagement part 911*a* and 911*b* of the detachable unit 60, so the image forming apparatus 1 regulates the position of the direction toward the sheet metal 26 of the detachable unit 60, that is, the position of the horizontal direction of the detachable unit 60. Also, the abutment part 902*a* and 902*b* of the side frames 21*a* and 21*b* engage with the second engagement part 912*a* and 912*b* of the detachable unit 60, so the image forming apparatus 1 regulates the position of the detachable unit 60 in the vertical direction As a result, when the detachable unit 60 is installed in the main body frame 2, the image forming apparatus 1 can position the detachable unit 60 at the predetermined position inside of the main body frame 2.

The detachable unit 60 is positioned at the predetermined position when it is installed in the main body frame 2. The position of the detachable unit 60 at this time is the position that the abutment part 610*a* disposed on the sheet guide 610 faces the guide position part 26*a* of the sheet metal 26 (refer to FIG. 1).

Figure 5A:
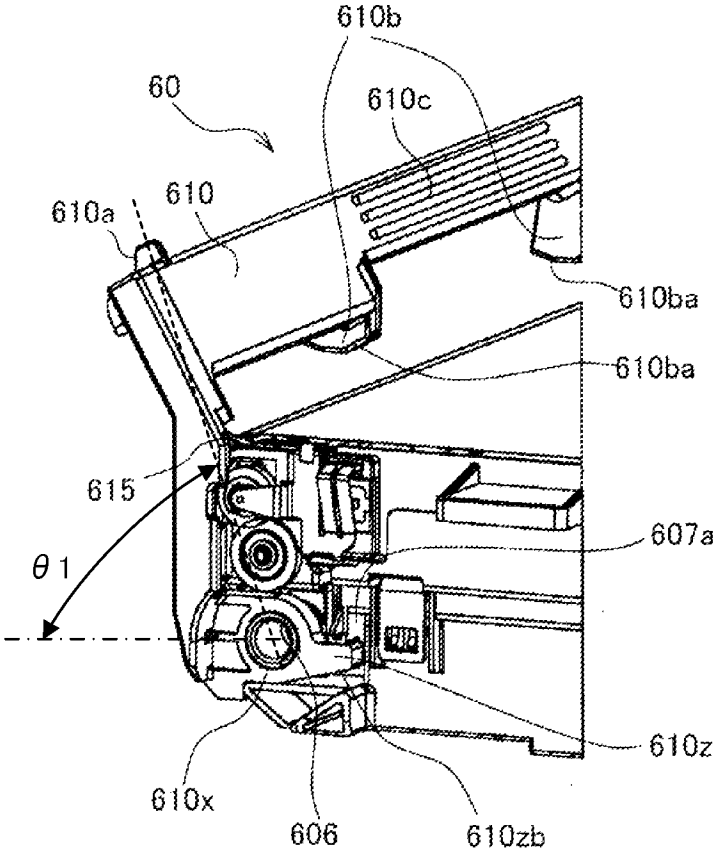

The sheet guide 610, as described above, has a configuration to be able to rotate and move as the shaft part 606 (refer to FIG. 3) is the center. FIGS. 5A and 5B illustrate the movement of the sheet guide 610. FIG. 5A illustrates the state that the sheet guide 610 leans in the slant direction as the shaft 606 is the center, and FIG. 5B illustrate the state the sheet guide 610 stands up in the perpendicular direction as the shaft 606 is the center.

As illustrated in FIG. 5A, the opening part 610*x* is disposed near the lower end part of the sheet guide 610. The shaft part 606 disposed in the waste toner box 605 fits inside the opening part 610$x$. The opening part 610$x$ and the shaft part 606 are formed in the circular shape of which the diameters are about same. The shaft 606 rotatably movably supports the sheet guide 610 by fitting inside of the opening part 610$x$ of the sheet guide 610. Therefore, the opening part 610$x$ (the shaft 606) functions as a rotary movement fulcrum of the sheet guide 610.

The sheet guide 610 is provided with the position lever 610$z$ near the lower end part. The position lever 610$z$ is a part to determine the rotary movement position (angle) of the sheet guide 610. A part near the lower end part of the sheet guide 610 protrudes from the shaft part 606 in one direction. Thereby, the position lever 610$z$ is formed.

In contrast, the detachable unit 60 is provided with the first lever positioning part 607$a$ (refer to FIG. 5A) to contact the tip of the positioning lever 610$z$ and position the protrusion part 610$a$ of the sheet guide 610 at the predetermined position (the first position P1 described later (refer to FIG. 6) and the second lever positioning part 607$b$ (refer to FIG. 5B) to contact the tip of the positioning lever 610$z$ and position the protrusion part 610$a$ of the sheet guide 610 at the predetermined position (the second position P2 (refer to FIG. 6)).

The positioning lever 610$z$ rotates and moves around the shaft part 606 (the opening part 610$x$) of the sheet guide 610. As a result, the positioning lever 610$z$ can rotate and move between the first lever positioning part 607$a$ and the second lever positioning part 607$b$, which are disposed in the waste toner box 605 as the shaft 606 (the opening part 610$x$) is the center.

Figure 6:
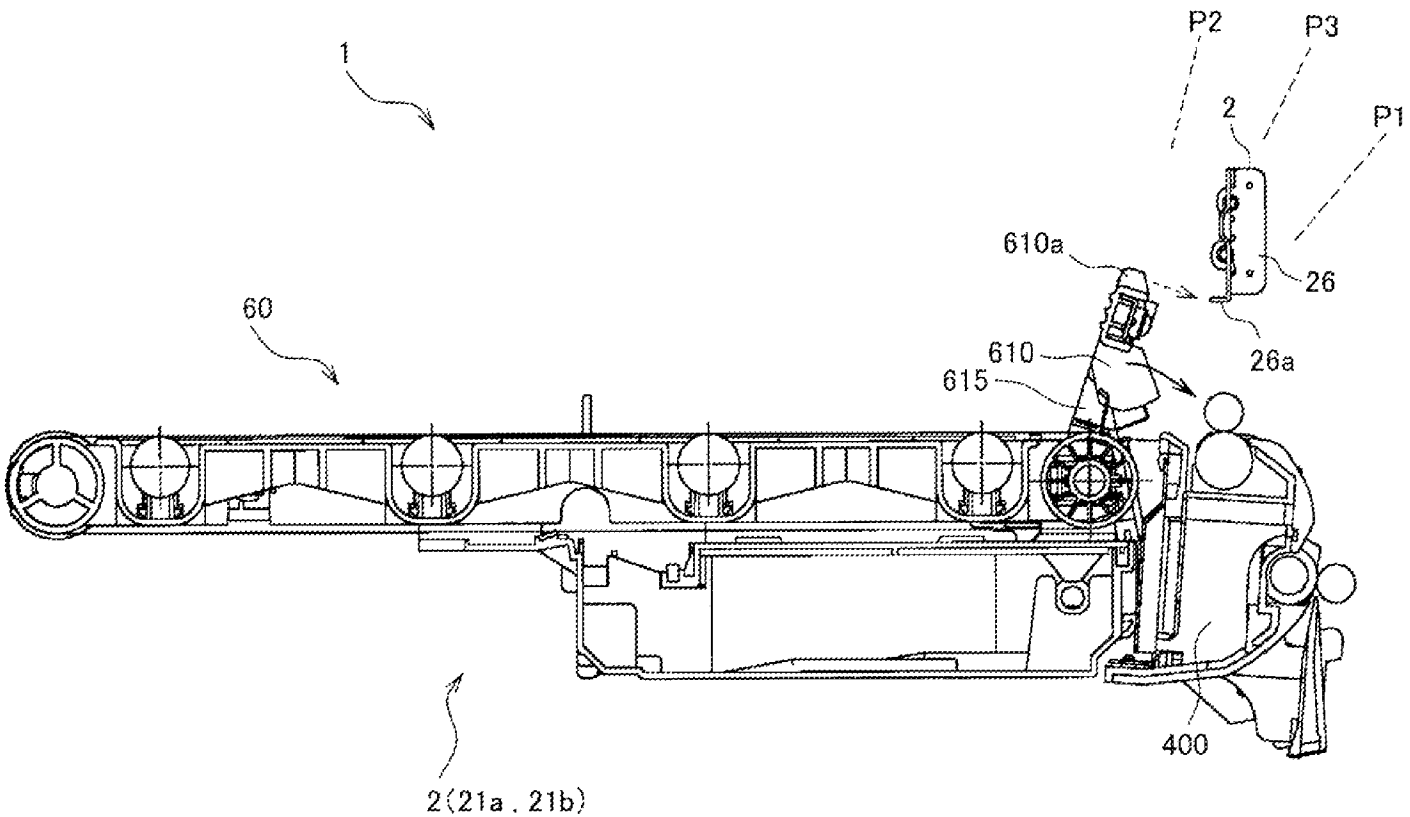
FIG. 6 is a view (1) illustrating a movement of the image forming apparatus according to the first embodiment.

Here, in the explanation, the position that the tip of the position lever 610$z$ touches the first lever position part 607$a$ of the waste toner box 605 is "the first position P1" (refer to FIG. 6), and the position that the tip of the position lever 610$z$ touches the second lever position part 607$b$ of the waste toner box 605 is "the second position P2" (refer to FIG. 6). Therefore, the positioning lever 610$z$ can rotate and move between the first position P1 and the second position P2 when the shaft 606 is the center.

In the first embodiment, an angle θ2 between the line connects the second position P2 and the shaft 606 (hole 610$x$) and the horizontal direction is larger than another angle θ1 between the line connects the first position P1 and the shaft 606 (hole 610$x$) and the horizontal direction. Herein, these two angles are at a side facing the guide position part 26$a$ of the sheet metal 26.

The detachable unit 60 is provided with the flat spring 615 as a bias member to bias the sheet guide from the second position P2 toward the first position P1. As illustrated in FIG. 5B, the fixed end 615$a$ of the flat spring 615 is fixed on the transfer part 600, and the free end 615$b$ side of the flat spring 615 engages with the engagement part 610$e$ of the sheet guide 600. Thereby, the flat spring 615 biases the sheet guide 610 in the direction the arrow D orients that is the direction of the first position P1 (the direction that the abutment part 610$a$ of the sheet guide 610 contacts the sheet metal 26 as the position part).

In this embodiment, as illustrated in FIG. 5A, when the external power is not applied, the sheet guide 610 of the detachable unit 60 is in the state that the first contacted surface 610$za$ of the positioning lever 610$z$ contacts the first lever positioning part 607$a$ of the waste toner box 605 and the rotation and the movement of the sheet 610 are regulated at the first position P1.

In contrast, as illustrated in FIG. 5B, when the external power is applied, the sheet guide 610 of the detachable unit 60 is in the state that the second contacted surface 610$zb$ of the position lever 610$z$ contacts the second lever position part 607$b$ of the waste toner box 605 and the rotation and the movement of the sheet guide 610 are regulated at the second position P2.

In the image forming apparatus 1, the sheet guide 610 also functions as the handle part 610$c$ is disposed to be able to rotate and move on the detachable unit 60 that has a configuration to be able to attach and detach with respect to the main body frame 2. And, the detachable unit 60 is installed in the main body frame 2, so the abutment part 610$a$ of the sheet guide 610 abuts the guide position part 26$a$ of the sheet metal 26 of the main body frame 2, and the position of the image forming apparatus 1 is regulated. As a result, by installing the detachable unit 60 in the main body frame 2, the image forming apparatus 1 can position the sheet guide 610 at the predetermined position at the same time.

Thereby, the image forming apparatus can maintain the position accuracy of the sheet guide 610 with respect to the before and after mechanisms (here, the sheet carrying roller 401$a$ and 401$b$ of the sheet carrying part 400, the toner image forming part 510, and the transfer part of the image forming part 500) high.

In the first embodiment, the detachable unit 60 is configured as a sheet carrying unit to carry the sheet 101, and the detachable unit 60 as a sheet carrying unit is configured as a belt carrying unit provided with the endless carrying belt 603 and a plurality of the rollers 601, 602, and 604. However, the detachable unit 60 can also be configured as a unit, for example, a fuser unit, a double sided print unit and the like, instead of a sheet carrying unit.

Movement of Image Forming Apparatus

The movement of the image forming apparatus 1 according to the first embodiment is explained. Here, first of all, the whole movement of the image forming apparatus 1 is explained, and next, the movement around the detachable unit 60 is explained.

First of all, referring to FIG. 1 and FIG. 2, the whole movement of the image forming apparatus 1 is explained. The image forming apparatus 1 receives the print data from the host device (not illustrated). Then, in the image forming apparatus 1, the toner image forming part 510 (refer to FIG. 2) makes the photosensitive drum 511 rotate and conducts the image (toner image) forming treatment.

At that time, in the image forming apparatus 1, the charge roller 512 equally charges the surface of the photosensitive drum 511. Then, the LED head 520 partially exposes the surface of the photosensitive drum 511 based on the print data. Thereby, the image forming apparatus 1 forms the electrostatic latent image on the surface of the photosensitive drum 511.

In contrast, in the image forming apparatus 1, the toner is supplied to the supply roller 514 from the toner contain part 516 in advance. When the development roller 513 rotates accompanied by the rotation of the photosensitive drum 511, the supply roller 514 supplies the toner to the development roller 513 and makes the toner adhere to the surface of the development roller 513. The toner adhered on the surface of the development roller 513 contacts the development blade 515 accompanied by the rotation of the development roller 513, and the thickness of the toner is regulated.

After this, in the image forming apparatus 1, the development roller 513 supplies the toner to the photosensitive drum 511. At this time, the toner adheres on the electrostatic latent image formed on the surface of the photosensitive drum 511. Thereby, the toner image is formed on the surface of the photosensitive drum 511.

In the image forming apparatus 1, when the toner image is formed on the surface of the photosensitive drum 511, the transfer part 600 conducts the transfer treatment. At that time, in the transfer part 600, while the carrying belt 603 carries the sheet 101, the transfer roller 604 pulls the toner image formed on the surface of the photosensitive drum 511. As a result, the toner image is transferred from the photosensitive drum 511 to the sheet 101.

When the toner image is transferred from the photosensitive drum 511 to the sheet 101, the image forming apparatus 1 carries the sheet 101 to the fuser part 700 (refer to FIG. 1). When the sheet 101 is carried, the fuser part 700 conducts the fuser treatment. At that time, the fuser part 700 heats and pressurizes the sheet 101 and makes the toner image transferred to the surface of the sheet 101 melt and secure on the sheet 101.

When the toner image is secured on the sheet 101, the image forming apparatus 1 carries the sheet 101 to the stack part 805 and ejects it on the stack part 805. The whole movement of the image forming apparatus 1 is described above.

Next, referring to FIGS. 6, 7, 8, and 9, the movement around the detachable unit 60 of the image forming apparatus 1 according to the first embodiment is explained. FIGS. 6, 7, 8, and 9 are views illustrating the movement of the image forming apparatus 1 according to the first embodiment.

(Movement of Detachable Unit at Time of Installation)

First of all, the movement of the detachable unit 60 of the image forming apparatus 1 at the time of installation is explained. FIG. 6 illustrates the movement of the image forming apparatus 1 when the detachable unit 60 is installed into the main body frame 2.

In the detachable unit 60, the flat spring 615 (refer to FIGS. 5A and 5B) always biases the sheet guide 610 from the second position P2 (refer to FIG. 6) to the first position P1 (refer to FIG. 6). Therefore, as illustrated in FIG. 6, when the detachable unit 60 is removed from the main body frame 2, the sheet guide 610 rotates and moves from the second position P2 to the first position P1 by accepting the bias power from the flat spring 615. As a result, the sheet guide 610 is in the state that the first contacted part 610*za* (refer to FIG. 5B) of the position layer 610*z* contacts the first lever position part 607*a* (refer to FIG. 5A). Thus, when the detachable unit 60 is removed from the main body frame 2, the abutment part 610*a* of the sheet guide 610 is positioned at the first position P1.

The user grips the handle part 610*c* of the sheet guide 610, carries the detachable unit 60 in the vicinity of the main body frame 2, and installs the detachable unit 60 into the main body frame 2. At that time, while rotating the sheet guide 610 from the first position P1 (refer to FIG. 6) to the second position P2 (refer to FIG. 6), the user installs the detachable unit 60 into the main body frame 2.

After installing the detachable unit 60 into the main body frame 2, the user release his/her hand from the handle part 610*c* of the sheet guide 610. At this time, the sheet guide rotates and moves from the second position P2 to the first position P1 by accepting the bias power from the flat spring 615. Thereby, the sheet guide 610 is in the state that the abutment part 610*a* contacts the guide position part 26*a* of the sheet metal 26 of the main body frame 2.

After this, the detachable unit 60 enters inside of the main body frame 2 and is positioned at the predetermined position. At that time, accompanied by the movement of the detachable unit 60, in the sheet guide 610, the abutment part 610*a* is pressured by the guide position part 26*a* of the sheet metal 26 of the main body frame 2, and pushed back from the first position P1 to the second position P2. As a result, the abutment part 610*a* of the sheet guide 610 is positioned between the first position P1 and the second position P2 (hereinafter referred to as "the third position P3 (refer to FIG. 6)"). Thus, when the detachable unit 60 is installed into the main body frame 2, the abutment part 610*a* of the sheet guide 610 moves from the first position P1 to the third position P3 and is positioned at the third position P3.

(Movement at Time of Printing)

Figure 7:
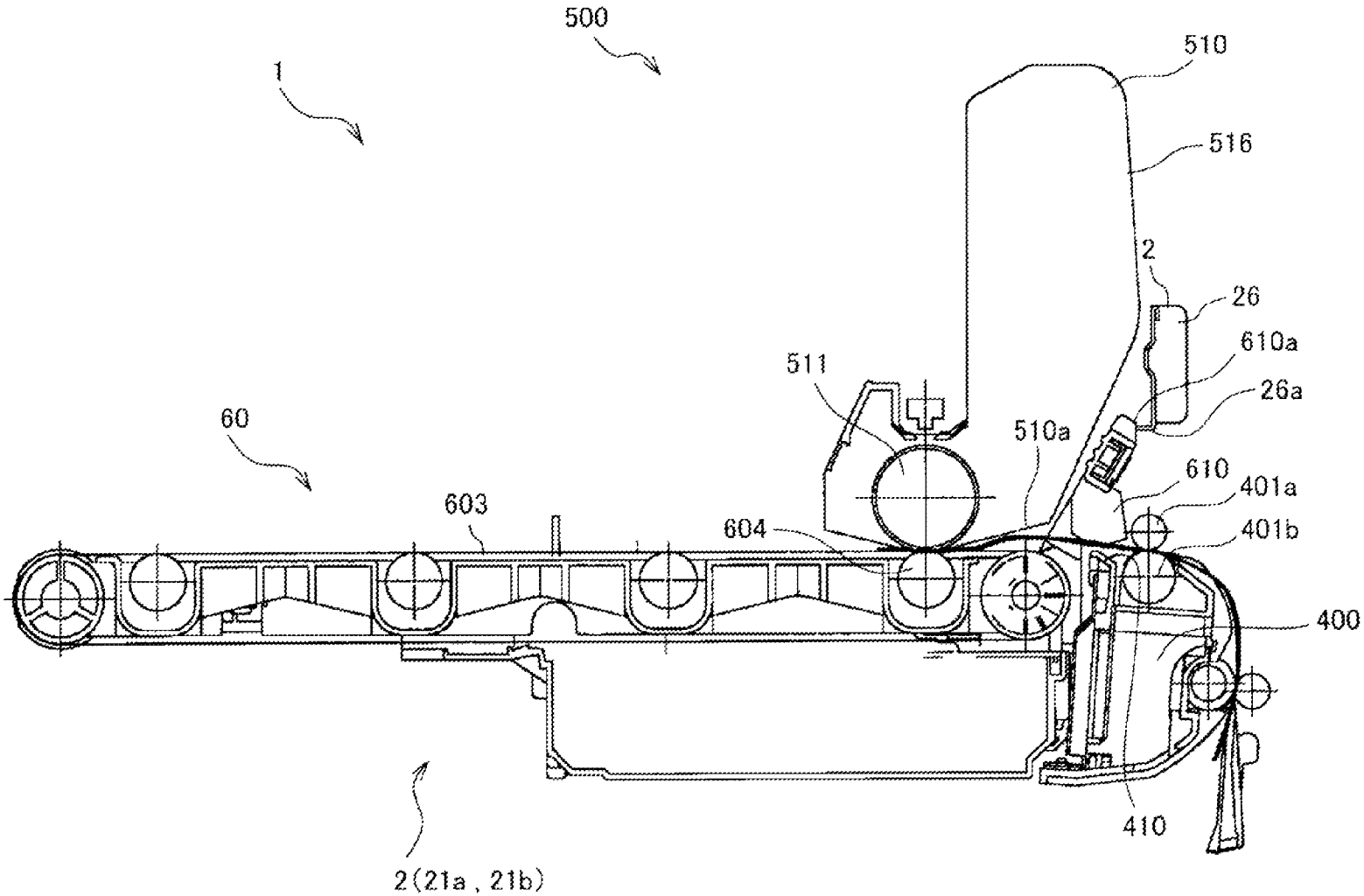
FIG. 7 is a view (2) illustrating a movement of the image forming apparatus according to the first embodiment.

Next, the movement of the image forming apparatus 1 at the time of printing is explained. At the time of printing, the image forming apparatus 1 conducts the image (toner image) forming treatment, the transfer treatment, and the fuser treatment. FIG. 7 illustrates the carrying movement of the sheet 101 from the sheet carrying part 400 to the image forming part 500 conducted at the time of printing.

The motor disposed in the main body frame 2 (not illustrated) drives, so, in the image forming apparatus 1, the sheet delivery part 200 delivers the sheet 101 from the sheet tray 100 toward the sheet carrying part 400, and the sheet carrying rollers 401*a* and 401*b* of the sheet carrying part 400 carries the sheet 101 toward the image forming part 500.

At this time, the sheet 101 is guided between the guide part 610*b* of the sheet guide 610 disposed in the detachable unit 60 and the carrying part guide 410 disposed in the sheet carrying part 400 by the guide part 610*b* and the carrying guide 410, and carried toward the image forming part 500.

After this, the carrying belt 603 carries the sheet 101 toward the fuser part 700. At that time, the sheet 101 passes between the guide surface 510*a* formed at the lower end part of the toner image forming part 510 of the image forming part 500 and the carrying belt 603, and passes between the photosensitive drum 511 of the toner image forming part 510 and the transfer roller 604 of the fuser part 600. At this time, the toner image is transferred to the surface of the sheet 101 from the photosensitive drum 511.

The image forming apparatus 1 has four toner image forming parts 510. When the color printing is conducted, the image forming apparatus 1 piles each color of the toner images of black, yellow, magenta, and cyan respectively formed on four toner image forming parts 510 and transfers them to the sheet 101. Thereby, the color image is formed on the surface of the sheet 101.

After this, the sheet 101 is heated and pressurized at the transfer part 700. Thereby, the toner image is secured on the sheet 101. After securing the toner image on the sheet 101, the image forming apparatus 1 carries the sheet 101 toward the stack part 805 and ejects it on the stack part 805.

(Movement of Detachable Unit at Time of Removal)

Figure 8:
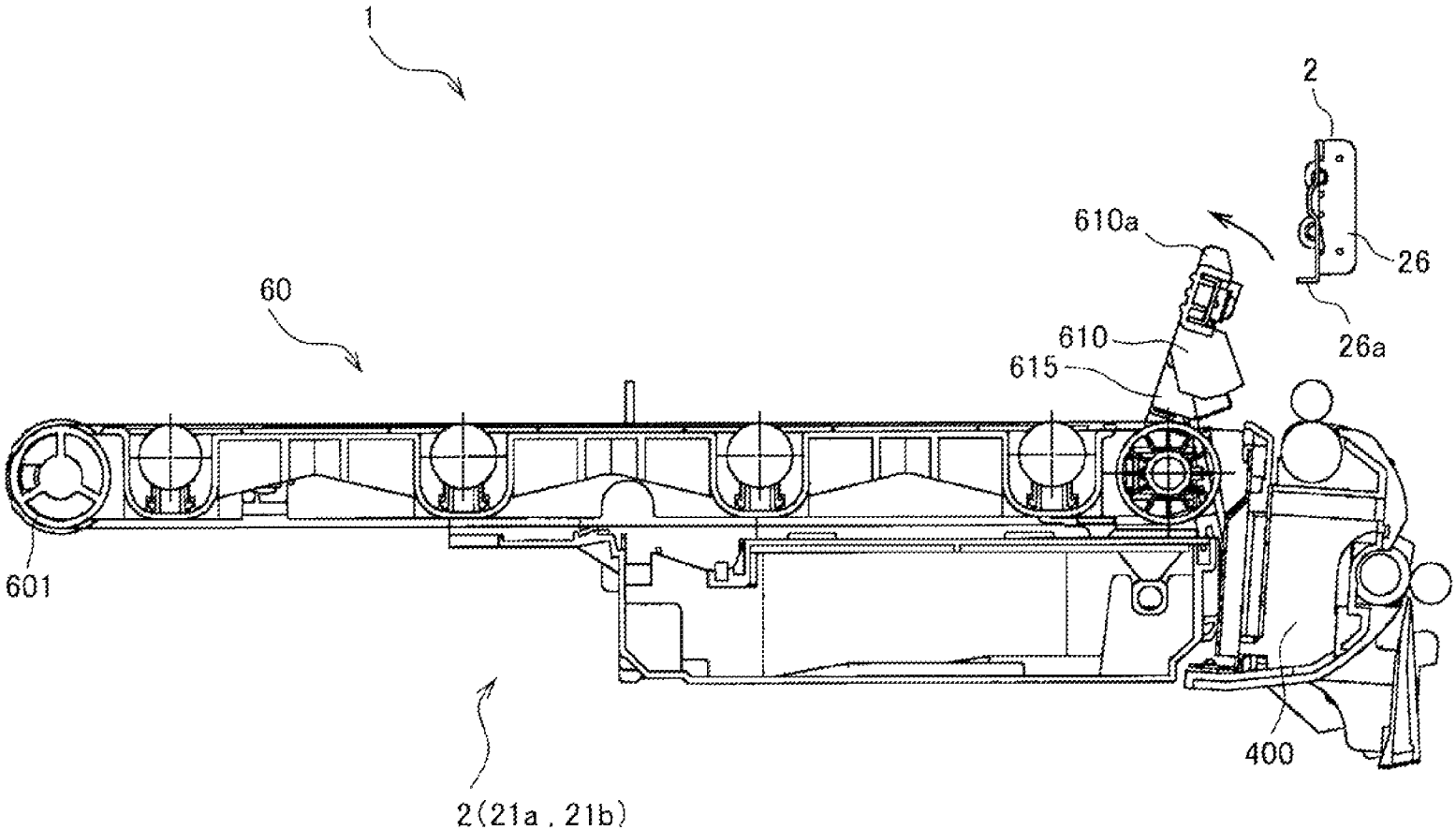
FIG. 8 is a view (3) illustrating a movement of the image forming apparatus according to the first embodiment.
Figure 9:
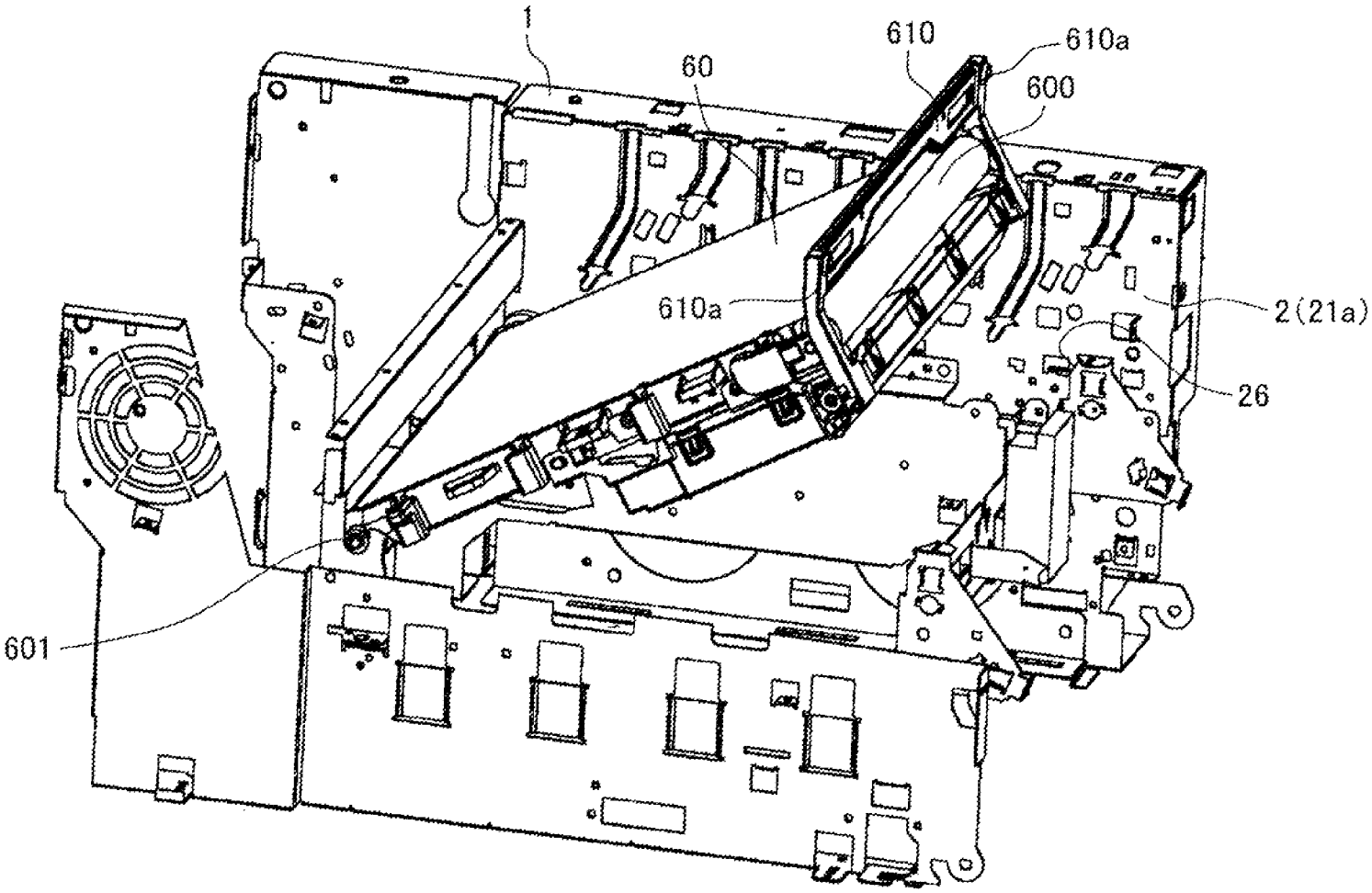
FIG. 9 is a view (4) illustrating a movement of the image forming apparatus according to the first embodiment.

Next, the movement of the image forming apparatus 1 at the time of removal of the detachable unit 60 is explained. FIG. 8 and FIG. 9 illustrate the movements of the image forming apparatus 1 when the detachable unit 60 is removed from the main body frame 2.

When the user removes the detachable unit 60 from the main body frame 2, the user grips the handle part 610*c* of the sheet guide 610 and gives the external power to resist the bias power of the flat spring 615 acting from the second position P2 (refer to FIG. 6) to the first position P1 (refer to FIG. 6) to the sheet guide 610.

Thus, when the detachable unit 60 is removed from the main body frame 2, the sheet guide 610 receives the external power acting from the first position P1 to the second position P2 by the user.

Therefore, the sheet guide 610 is in the state that the second contacted part 610*zb* (refer to FIG. 5A) of the position lever 610*z* contacts the second lever position part 607*b* (refer to FIG. 5B). As a result, the abutment part 610*a* of the sheet guide 610 moves its position from the third position P3 (refer to FIG. 6) to the second position P2 (refer to FIG. 6).

Thereby, the user can pull out the detachable unit 60 in the upper direction of the main body frame 2, that is, can attach and detach the detachable unit 60 from the main body frame 2.

After attaching and detaching the detachable unit 60 from the main body frame 2, the user releases his/her hand from the handle part 610*c* of the sheet guide 610. Then, the sheet guide does not receive the external power from the user.

At this time, the sheet guide 610 receives the bias power from the flat spring 615 and rotates and moves from the second position P2 (refer to FIG. 6) to the first position P1 (refer to FIG. 6). Thereby, the sheet guide 610 is in the state that the first contacted part 610*za* (refer to FIG. 5B contacts the first lever position part 607*a* (refer to FIG. 5A). As a result, the abutment part 610*a* of the sheet guide 610 moves its position from the second position P2 (refer to FIG. 6) to the first position P1 (refer to FIG. 6).

In the image forming apparatus 1 according to the first embodiment, the sheet guide 610 also functions as the handle part 610*c* is disposed in the detachable unit 60 so as to be able to rotate and move. And, the detachable unit 60 is installed into the main body frame 2, so the abutment part 610*a* of the sheet guide 610 abuts the guide position part 26*a* of the sheet metal 26 on the main body frame 2, and the position of the image forming apparatus 1 is regulated. As a result, the detachable unit 60 is installed into the main body frame 2 so that the image forming apparatus 1 can position the sheet guide 610 at the predetermined position at the same time.

Such image forming apparatus 1 has a configuration that the detachable unit 60 and the sheet guide 610 are positioned together accompanied by the installation movement of the detachable unit 60. Therefore, the image forming apparatus 1 can maintain the position accuracy of the sheet guide 610 with respect to the before and after mechanisms (here, the sheet carrying roller 401*a* and 401*b* of the sheet carrying part 400, the toner image forming part 510 of the image forming part 500, and the transfer part 600) high. As a result, the image forming apparatus 1 can improve the carrying performance.

Also, in the image forming apparatus 1, the sheet guide 610 is disposed in the detachable unit 60, so the sheet guide 610 can be arranged in the vicinity of the toner image forming part 510. Therefore, the image forming apparatus 1 can also further improve the carrying performance by this.

Also, in the image forming apparatus 1, the sheet guide 610 has the handle part 610*c* as a grip part. Thereby, using the space to mount the grip part to grip the detachable unit 60, the image forming apparatus 1 can mount the sheet guide 610. Therefore, the image forming apparatus 1 can downsize the main body frame 2.

According to the image forming apparatus 1 described above, the detachable unit 60 is installed in the device main body (main body frame 2) so that the sheet guide 610 can be positioned at the predetermined position at the same time.

Second Embodiment

Figure 10:
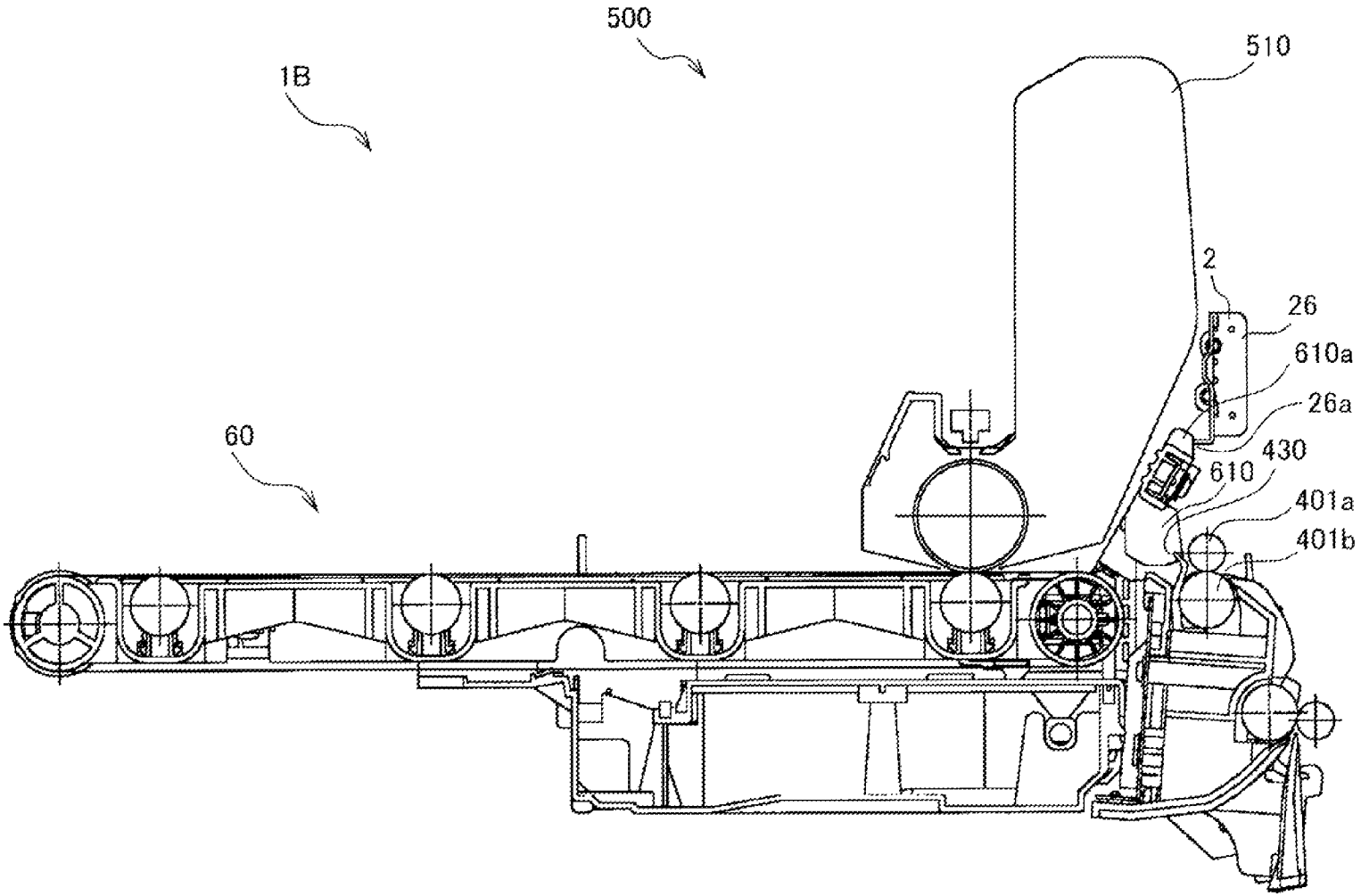
FIG. 10 is a view (1) illustrating a configuration of an image forming apparatus according to the second embodiment.
Figure 11:
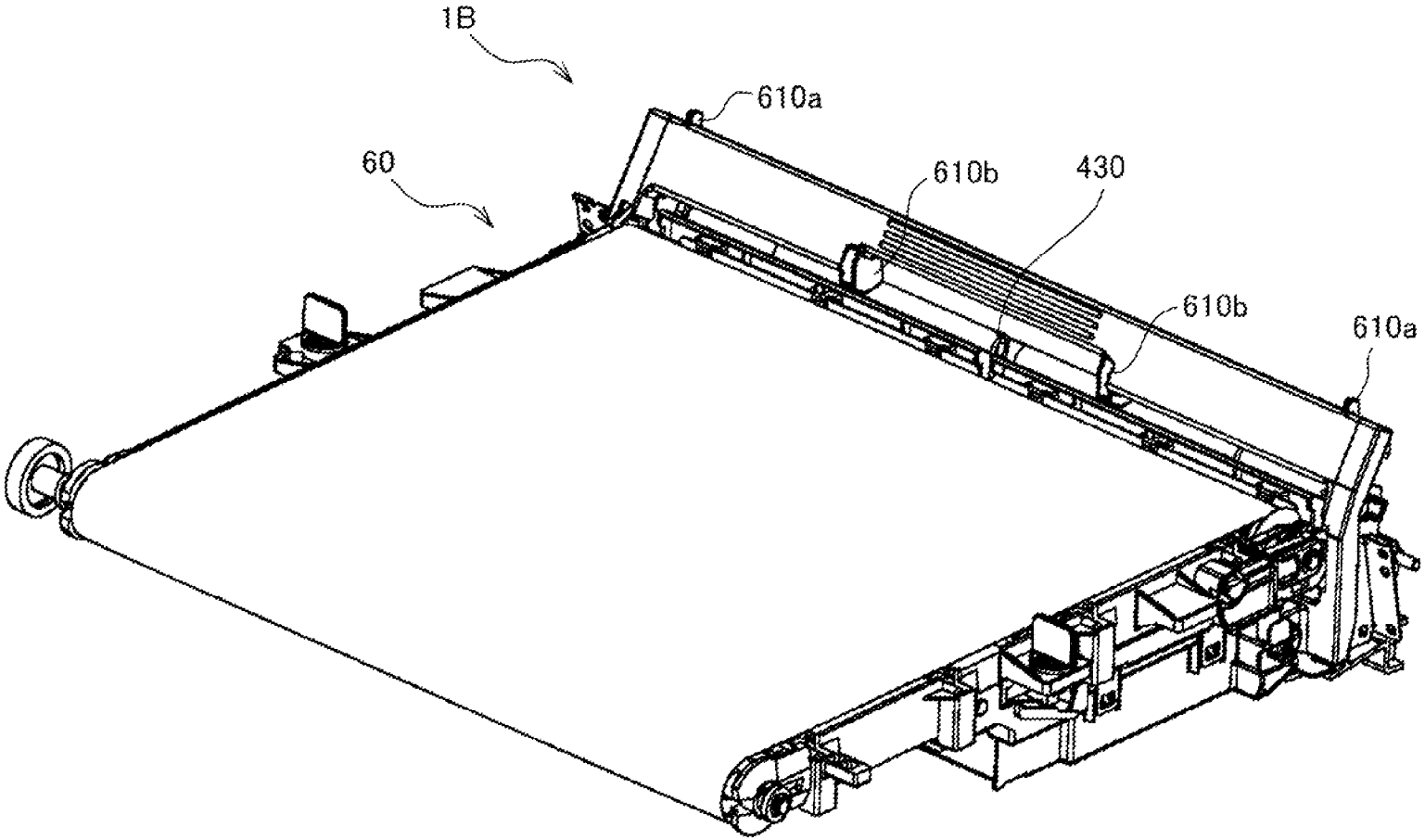
FIG. 11 is a view (2) illustrating a configuration of the image forming apparatus according to the second embodiment.

Referring to FIG. 10 and FIG. 11, the configuration of the image forming apparatus 1B according to the second embodiment is explained. FIGS. 10 and 11 are views illustrating the configuration of the image forming apparatus according to the second embodiment.

Compared to the image forming apparatus 1 (refer to FIG. 2) according to the first embodiment, the image forming apparatus 1B according to the second embodiment is different because the sensor lever 430 and the sensor (not illustrated) are disposed in the sheet carrying part 400. Other configurations are same as the image forming apparatus 1 according to the first embodiment.

The sensor lever 430 and the sensor (not illustrated) are configuration elements for the control part (not illustrated) of the image forming apparatus 1B to detect the position of the sheet 101. The tip of the sensor lever 430 is disposed in the sheet carrying part 400 rockably arranged at the side of the main body frame 2 (device main body) (refer to FIG. 1). When the sheet 101 carried by the sheet carrying rollers 401*a* and 401*b* of the sheet carrying part 400 touches the tip of the sensor lever 430, the sensor lever 430 inclines. The sensor (not illustrated) outputs the signal to show the inclination of the tip of the sensor lever 430 to the control part (not illustrated). Thereby, the control part (not illustrated) detects that the tip of the sheet 101 reached the position of the sensor lever 430.

As illustrated in FIGS. 10 and 11, the sensor lever 430 is arranged at the downstream position of the sheet rollers 401*a* and 401*b* and also at the position to overlap with the sheet guide 610 to guide the traveling of the sheet 101 in the vertical direction. In the second embodiment, the sensor lever 430 is arranged between the two guide parts 610*b* of the sheet guide 610. The sensor (not illustrated) is arranged around the tip of the sensor lever 430.

Figure 12:
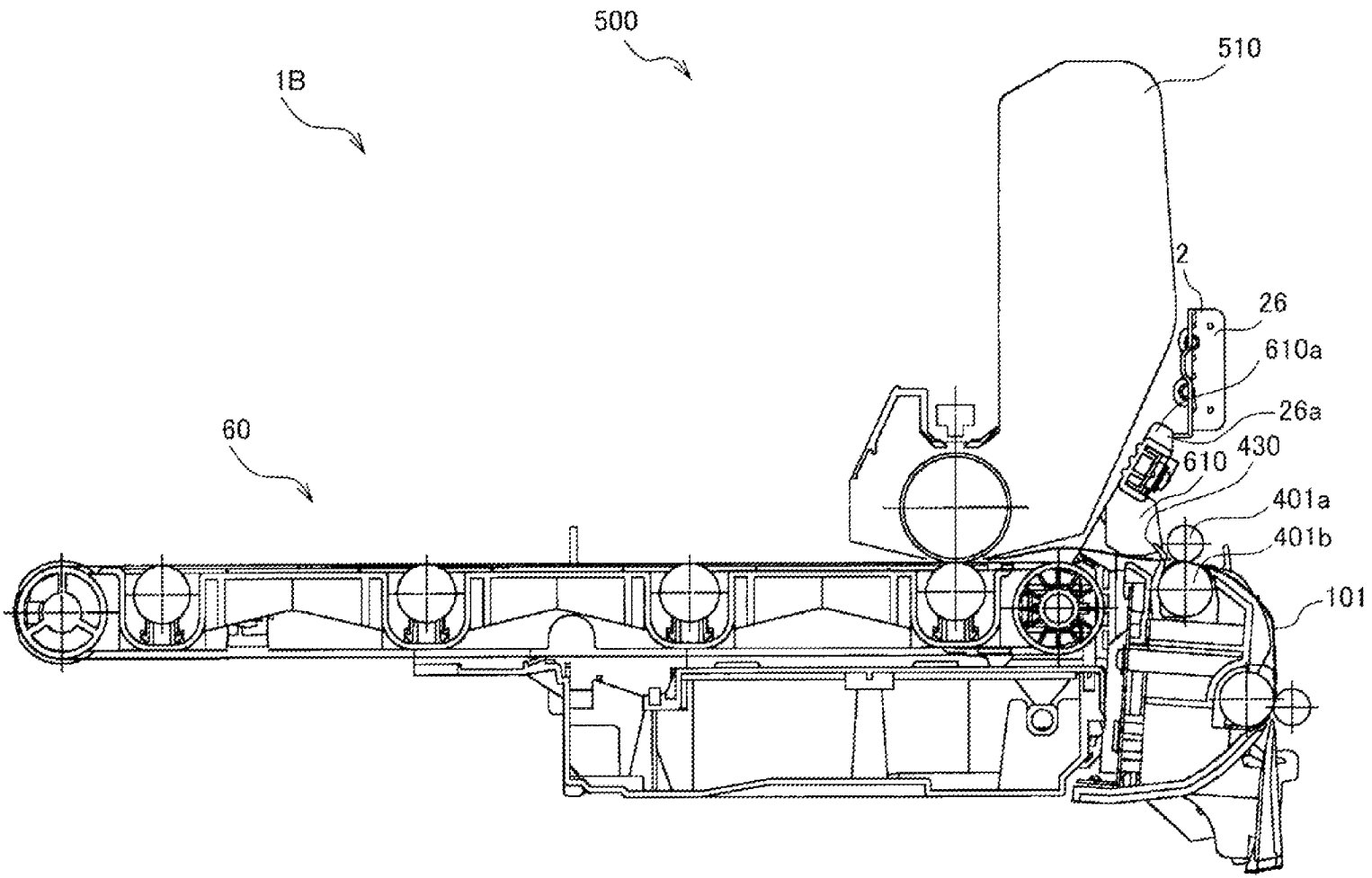
FIG. 12 is a view illustrating a movement of the image forming apparatus according to the second embodiment.

Referring to FIG. 12, the movement of the image forming apparatus 1B is explained. FIG. 12 is a view illustrating the movement of the image forming apparatus 1B according to the second embodiment.

At the time of printing, same as the image forming apparatus 1 according to the first embodiment, the image forming apparatus 1B is in the state that the sheet guide 610 is pushed by the guide position part 26*a* of the sheet metal 26 of the main body frame 2, and the abutment part 610*a* of the sheet guide 610 is positioned at the third position (refer to FIG. 6).

At the time of printing, same as the image forming apparatus 1 according to the first embodiment, in the image forming apparatus 1B according to the second embodiment, the motor (not illustrated) disposed in the main body frame 2 drives, so the sheet delivery part 200 delivers the sheet 101 from the sheet tray 100 to the sheet carrying part 400, and the sheet carrying rollers 401*a* and 401*b* of the sheet carrying part 400 carry the sheet 101 toward the image forming part 500.

At that time, in the image forming apparatus 1B, the sheet 101 carried by the sheet carrying rollers 401*a* and 401*b* contacts the tip of the sensor lever 430 and presses the tip of the sensor lever 430. As a result, the tip of the sensor lever 430 inclines in the direction of the toner image forming part 510 of the image forming part 500. The sensor (not illustrated) of the image forming apparatus 1B outputs the signal to show the inclination of the tip of the sensor lever 430 to the control part (not illustrated) of the image forming apparatus 1B. Thereby, the control part (not illustrated) detects that the tip of the sheet 101 reached the position of the sensor lever 430. The control part (not illustrated) feeds the position of the tip of the sheet 101 back to the control of the position to write out the image.

In the image forming apparatus 1B according to the second embodiment, same as the image forming apparatus 1 according to the first embodiment, the sheet guide 610 is disposed in the detachable unit 60. Then, in the image forming apparatus 1B, the detachable unit 60 is installed in the main body frame 2, so the abutment part 610*a* of the sheet guide 610 abuts the guide position part 26*a* of the sheet metal 26 of the main body frame 2, and the position of the image forming apparatus 1B is regulated. As a result, the detachable unit 60 is installed in the main body frame 2 so that the image forming apparatus 1B can position the sheet guide 610 at the predetermined position at the same time.

Such image forming apparatus 1B, same as the image forming apparatus 1 according to the first embodiment, has a configuration that the detachable unit 60 and the sheet guide 610 are positioned together. Therefore, same as the image forming apparatus 1 according to the first embodiment, the image forming apparatus 1B can maintain the position accuracy of the sheet guide 610 with respect to the before and after mechanisms (here, the sheet carrying rollers 401*a* and 40*b* of the sheet carrying part 400, the toner image forming part 400 of the image forming part 500, and the transfer part 600) high. As a result, the image forming apparatus 1B can improve the carrying performance and the position accuracy to write out the image.

Also, in the image forming apparatus 1B, same as the image forming apparatus 1 according to the first embodiment, the sheet guide 610 is disposed in the detachable unit 60, so the sheet guide 610 can be arranged in the vicinity of the toner image forming part 510. Therefore, same as the image forming apparatus 1 according to the first embodiment, the image forming apparatus 1B can also improve the carrying performance and the position accuracy to write out the image by this.

Furthermore, in the image forming apparatus 1B, different from the image forming apparatus 1 according to the first embodiment, the sensor lever 430 is arranged at the position to overlap the sheet guide 610 to guide the traveling of the sheet 101 in the vertical direction. Therefore, the image forming apparatus 1B can improve the detection accuracy of the position of the tip of the sheet 101 by the sensor lever 430. As a result, the image forming apparatus 1B can also further improve the carrying performance and the position accuracy to write out the image by this.

The present invention is not limited to the embodiments described above, but can be changed or transformed as far as the content of the present invention is not deviated. For example, the present invention can be used not only as a printer, but also as a facsimile machine, a multifunction machine, and a image forming apparatus of MFP and the like. "MFP" means the Multi Function Printer to which functions as a facsimile, a scanner, a copier and the like are added.

Also, for example, in the first and the second embodiments, the detachable unit 60 configured as a belt carrying unit that is one form of the sheet carrying units is explained. However, the present invention is also applicable when the detachable unit 60 is configured as a fuser unit, a double side print unit, or the like, that is a unit to be able to attach and detach, instead of the belt carrying unit.

Figure 13:
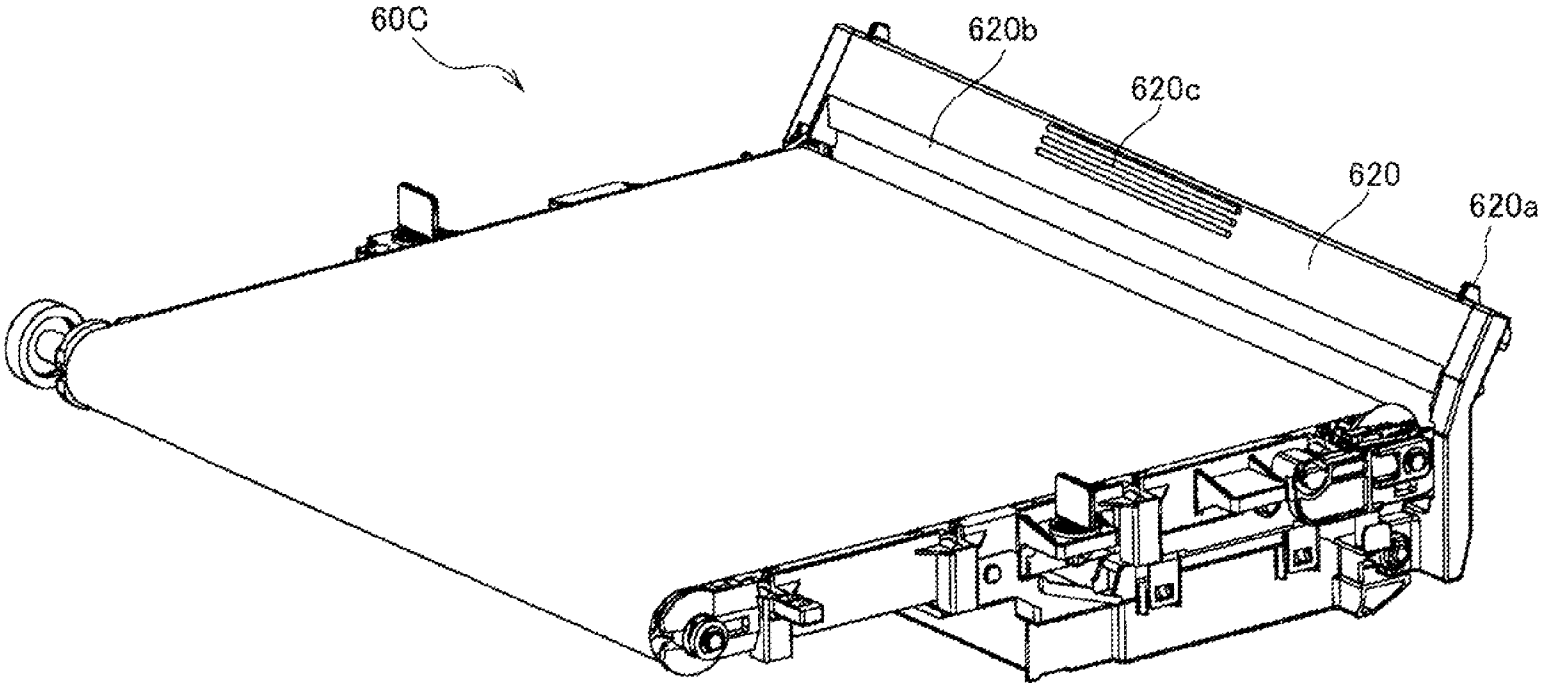
FIG. 13 is a view illustrating a configuration of a detachable unit according to the modification example.

Also, for example, in the detachable unit 60, one part of the configuration can be transformed. FIG. 13 is a view illustrating the configuration of the detachable unit 60*c* according to the modification example. Compared to the detachable unit 60 according to the first and the second embodiments, the detachable unit 60*c* according to the modification example is different because the sheet guide 620 is used instead of the sheet guide 610. As illustrated in FIG. 3, the sheet guide 620 is provided with the abutment part 620*a*, the guide part 620*b*, and the handle part 620*c*. The abutment part 620*a*, the guide part 620*b*, and the handle part 620*c* are respectively same configuration elements as the abutment part 610*a*, the guide part 610*b*, and the handle part 610*c* according to the first and the second embodiments. The abutment part 620*a* has the same shape as the abutment part 610*a* according to the first and the second embodiments. On the other hand, different from the guide part 610*b* according to the first and the second embodiments, the undersurface of the lower end part of the guide part 620*b* is formed in the flat shape across the whole width in the lateral direction. Also, different from the handle part 610*c* according to the first and the second embodiments, the handle part 620*c* has the shape that the girth of the handle part 620*c* is not divided by the guide part 610*b*. The sheet guide 620 contacts the sheet 101 by the abutment part 620*a* formed in the flat shape across the whole width in the lateral direction.

What is claimed is:

1. An image forming apparatus, comprising:

a device main body that includes a guide position part;

a detachable unit that is detachable and attachable to the device main body; and a sheet guide that is rotatably attached to the detachable unit and that guides a pathway of sheet, wherein the guide position part regulates a position of the sheet guide, when the detachable unit is mounted on the device main body, a position of the sheet guide is regulated by abutting the guide position part, the device main body further comprises a sheet carrying direction regulation part that regulates a position of the detachable unit in a sheet carrying direction, a unit direction regulation part that regulates a position of the detachable unit in a detachable/attachable direction of the detachable unit, and the detachable unit comprises a first engagement part that engages the sheet carrying direction regulation part and a second engagement part that engages the unit direction regulation part.

2. The image forming apparatus according to claim 1, wherein the detachable unit comprises a first lever position part and a second lever position part, the first lever position part contacting the sheet guide at a first position, and a second lever position part contacting the sheet guide at a second position that is different from the first position.

3. The image forming apparatus according to claim 2, wherein when the detachable unit is installed in the device main body, the sheet guide contacts the guide position part at a third position that is between the first position and the second position.

4. The image forming apparatus according to claim 1, wherein the detachable unit includes a bias part that biases the sheet guide in a direction from a second position towards a first position.

5. An image forming apparatus, comprising:

a device main body that includes a guide position part;

a detachable unit that is detachable and attachable to the device main body; and a sheet guide that is rotatably attached to the detachable unit and that guides a pathway of sheet, the sheet guide rotatable about a rotational axis;

wherein the guide position part regulates a position of the sheet guide, when the detachable unit is mounted on the device main body, a position of the sheet guide is regulated by abutting the guide position part, a part of the sheet guide is configured as a handle part of the detachable unit, the sheet guide includes a guide part that contacts the sheet, and the guide part is positioned between and abutment position between the sheet guide and the guide position part, and the rotational axis of the sheet guide.

6. The image forming apparatus according to claim 5, wherein the detachable unit comprises a first lever position part and a second lever position part, the first lever position part contacting the sheet guide at a first position, and a second lever position part contacting the sheet guide at a second position that is different from the first position.

7. The image forming apparatus according to claim 6, wherein when the detachable unit is installed in the device main body, the sheet guide contacts the guide position part at a third position that is between the first position and the second position.

8. The image forming apparatus according to claim 1, further comprising:

a detection member that detects a tip of a sheet, wherein when the detachable unit is mounted in the device main body and when the sheet guide contacts the guide position part, the detection member is positioned perpendicularly below an area in which the sheet guide regulates an image forming surface side of the sheet when viewed in a direction orthogonal to the sheet carrying direction.

9. The image forming apparatus according to claim 5, further comprising:

a detection member that detects a tip of a sheet, wherein when the detachable unit is mounted in the device main body and when the sheet guide contacts the guide position part, the detection member is positioned perpendicularly below an area in which the sheet guide regulates an image forming surface side of the sheet when viewed in a direction orthogonal to a sheet carrying direction.

10. The image forming apparatus according to claim 5, wherein the sheet guide includes a plurality of guide parts that guides the sheet by contacting the sheet, and the handle part is positioned between adjacent guide parts.

11. The image forming apparatus according to claim 5, wherein the detachable unit includes a bias part that biases the sheet guide in a direction from the second position towards the first position.

12. An image forming apparatus, comprising:

a device main body:

a detachable unit that is detachable and attachable to the device main body;

a sheet guide that guides a pathway of sheet; and a guide position part that regulates a position of the sheet guide, wherein the guide position part is disposed in the device main body, the sheet guide is disposed movably with respect to the detachable unit, when the detachable unit is mounted on the device main body, a position of the sheet guide is regulated by abutting the guide position part, the detachable unit comprises a first lever position part and a second lever position part, the first lever position part contacting the sheet guide at a first position, and the second lever position part contacting the sheet guide at a second position that is different from the first position.

13. The image forming apparatus according to claim 12, wherein the sheet guide is disposed rotatably and movably around a shaft part that is disposed in the detachable unit.

14. The image forming apparatus according to claim 12, wherein when the detachable unit is installed in the device main body, the sheet guide contacts the guide position part at a third position that is between the first position and the second position.

15. The image forming apparatus according to claim 12, further comprising:

a detection member that detects a tip of a sheet, wherein when the detachable unit is mounted in the device main body and when the sheet guide contacts the guide position part, the detection member is positioned perpendicularly below an area in which the sheet guide regulates an image forming surface side of the sheet when viewed in a direction orthogonal to a sheet carrying direction.

16. The image forming apparatus according to claim 15, wherein the detection member is disposed at an upstream side in the sheet carrying direction of the sheet with respect to the detachable unit.

17. The image forming apparatus according to claim 12, wherein the sheet guide is disposed on the detachable unit freely rotatably about a rotational axis, the sheet guide includes a position lever that protrudes in a predeterminded direction from the rotational axis, and an angle $\theta 2$ formed by a horizontal line and the position lever at the second position is larger than an angle $\theta 1$ formed by the horizontal line and the position lever at the first position.

18. The image forming apparatus according to claim 12, wherein the detachable unit includes a bias part that biases the sheet guide in a direction from a second position towards a first position.

* * * * *